US007884841B2

(12) United States Patent
Terao et al.

(10) Patent No.: US 7,884,841 B2
(45) Date of Patent: Feb. 8, 2011

(54) LINE THERMAL PRINTER

(75) Inventors: Hirotoshi Terao, Fukushima-ken (JP); Hisashi Hoshino, Fukushima-ken (JP); Toshiyuki Yamamoto, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 55 days.

(21) Appl. No.: 12/424,938

(22) Filed: Apr. 16, 2009

(65) Prior Publication Data

US 2009/0268006 A1 Oct. 29, 2009

(30) Foreign Application Priority Data

Apr. 25, 2008 (JP) ..... 2008-115525

(51) Int. Cl.
*B41J 29/17* (2006.01)

(52) U.S. Cl. ..... 347/171

(58) Field of Classification Search ..... 347/171; 400/120.01, 701
See application file for complete search history.

(56) References Cited

U.S. PATENT DOCUMENTS 7,256,807 B2 * 8/2007 Goto et al. ..... 347/197
2005/0285925 A1 12/2005 Goto et al.

FOREIGN PATENT DOCUMENTS

| | | |
|---|---|---|
| DE | 4212145 | * 10/1993 |
| JP | 63-035363 | * 2/1988 |
| JP | 06-312558 | * 11/1994 |
| JP | 09-188036 | * 7/1997 |
| JP | 11-321024 | * 11/1999 |
| JP | 2006-7541 | 1/2006 |

* cited by examiner

*Primary Examiner*—Huan H Tran
(74) *Attorney, Agent, or Firm*—Hunton & Williams, LLP

(57) ABSTRACT

A line thermal printer includes a platen roller and a line thermal head including a plurality of heating elements. The heating elements are disposed to face the entire area of a recording sheet in a width direction of the recording sheet and selectively generate heat. The recording sheet is interposed between the platen roller and the line thermal head. The line thermal printer performs printing at the interposed position on the recording sheet by the selective generation of heat of the heating elements while the recording sheet is moved. The line thermal printer includes a foreign material blocking member. The foreign material blocking member is disposed upstream of the interposed position to come in contact with an upper surface of the recording sheet, and prevents foreign materials, which are placed on the upper surface of the recording sheet, from being moved toward the interposed position.

7 Claims, 2 Drawing Sheets

LINE THERMAL PRINTER

CROSS REFERENCE TO RELATED APPLICATION

The present invention contains subject matter related to and claims the benefit of Japanese Patent Application No. 2008-115525 filed in the Japanese Patent Office on Apr. 25, 2009, the entire contents of which is incorporated herein by reference.

BACKGROUND

1. Technical Field

The present invention relates to a line thermal printer including a line thermal head that performs printing by the selective generation of heat of a plurality of heating elements. The heating elements are disposed so as to fate the entire area of a recording sheet in a width direction of the recording sheet, and selectively generate heat. Particularly, the present invention relates to a line thermal printer that prevents foreign materials from being bitten by a line thermal head.

2. Related Art

Conventional line thermal printers are known (for example, see Japanese Unexamined Patent Application Publication No. 2006-7541).

The line thermal printer will be described with reference to FIG. 2.

A platen roller 32, and a line thermal head 33 disposed above the platen roller 32 are provided in a frame 31*a*. A recording sheet 34 is fed between the line thermal head 33 and the platen roller 32.

Further, the line thermal head 33 is mounted on a long head mounting part 35, and ends of a pair of head levers 36 are fixed to both ends of the head mounting part 35 in a longitudinal direction of the head mounting part.

In addition, right ends of the head levers 36 in FIG. 2 are supported by a pivot 37 that is supported by side plates of the frame 31*a*, and the ends of the head levers to which the line thermal head 33 is fixed can be rotated about the pivot 37.

Since the line thermal printer is a thermal transfer printer, an ink ribbon 39 received in a ribbon cassette 38 is led between the platen roller 32 and the line thermal head 33. Meanwhile, when the line thermal printer performs printing while a thermal recording sheet is used as the recording sheet, the ink ribbon 39 does not need to be used.

Further, a paper feed roller 40 and a pressing roller 41 are provided on the left side of the platen roller 32 in FIG. 2. The recording sheet 34, which is pressed and interposed between the paper feed roller 40 and the pressing roller 41, can be fed in a feed direction, which is indicated by arrow A, or a direction opposite to the feed direction that is a right direction.

A ribbon peeling member 43 is provided downstream of the head mounting part 35 in the feed direction of the recording sheet 34 so that a heat insulating material 42 is provided between the ribbon peeling member and the head mounting part.

The printing operation of the thermal printer 31 in the related art will be described. When the head levers 36 are rotated clockwise and the line thermal head 33 is in a heat-up state, the ribbon cassette 38 is mounted in the frame 31*a*. Accordingly, the ink ribbon 39 is led between the platen roller 32 and the line thermal head 33.

After that, the recording sheet 34, which is pressed and interposed between the paper feed roller 40 and the pressing roller 41, is fed in a direction opposite to the feed direction that is indicated by arrow A, and is fed between the platen roller 32 and the line thermal head 33 that is in a heat-up state.

When an end 34*a* of the recording sheet 34 is fed to the vicinity of the paper feed roller 40, the heading of the recording sheet 34 is performed and the head-down of the line thermal head 33 is performed.

If the plurality of the heating elements of the line thermal head 33, which is in a head-down state, selectively generates heat on the basis of print information, and the recording sheet 34 is fed in the direction indicated by arrow A, the ink of the ink ribbon 39 is thermally transferred onto the recording sheet. As a result, a desired image may be printed on the recording sheet 34.

However, there are foreign materials, such as dust, grains of sand, or coatings of the thermal recording sheet, on the recording sheet 34 and the foreign materials are hard. Accordingly, if the foreign materials are bitten by the line thermal head 33, the line thermal head is damaged. For this reason, there is a concern that print quality on the recording sheet 34 deteriorates.

These and other drawbacks exist.

SUMMARY

An advantage of various embodiments is to provide a line thermal printer that can prevent foreign materials from being bitten by a line thermal head.

According to an embodiment, a line thermal printer may include a line thermal head and a platen roller. The line thermal head may include a plurality of heating elements that are disposed so as to face the entire area of a recording sheet in a width direction of the recording sheet and selectively generate heat. The platen roller may be disposed so that the recording sheet is interposed between the platen roller and the line thermal head. The line thermal printer may perform printing at the interposed position on the recording sheet by the selective generation of heat of the heating elements of the line thermal head while the recording sheet is moved. The line thermal printer includes a foreign material blocking member. The foreign material blocking member may be disposed upstream of the interposed position so as to come in contact with an upper surface of the recording sheet, and prevents foreign materials, which may be placed on the upper surface of the recording sheet, from being moved toward the interposed position.

According to another embodiment, the foreign material blocking member may be a brush.

According to another embodiment, the foreign material blocking member may be a plate.

According to yet another embodiment, the foreign material blocking member may be grounded and have an electricity removing function.

According to still another embodiment, the foreign material blocking member may be provided so as to face the recording sheet that is fed and moved from a sheet cassette.

In the line thermal printer according to various embodiments, the foreign material blocking member may prevent foreign materials, which are placed on the recording sheet, from reaching the line thermal head. Accordingly, the damage of the line thermal head caused by the foreign materials may be prevented, so that it may be possible to perform high-quality printing.

DESCRIPTION OF EXEMPLARY EMBODIMENTS

The following description is intended to convey a thorough understanding of the embodiments described by providing a number of specific embodiments and details involving line thermal printers. It should be appreciated, however, that the present invention is not limited to these specific embodiments and details, which are exemplary only. It is further understood that one possessing ordinary skill in the art, in light of known systems and methods, would appreciate the use of the invention for its intended purposes and benefits in any number of alternative embodiments, depending on specific design and other needs.

Figure 1:
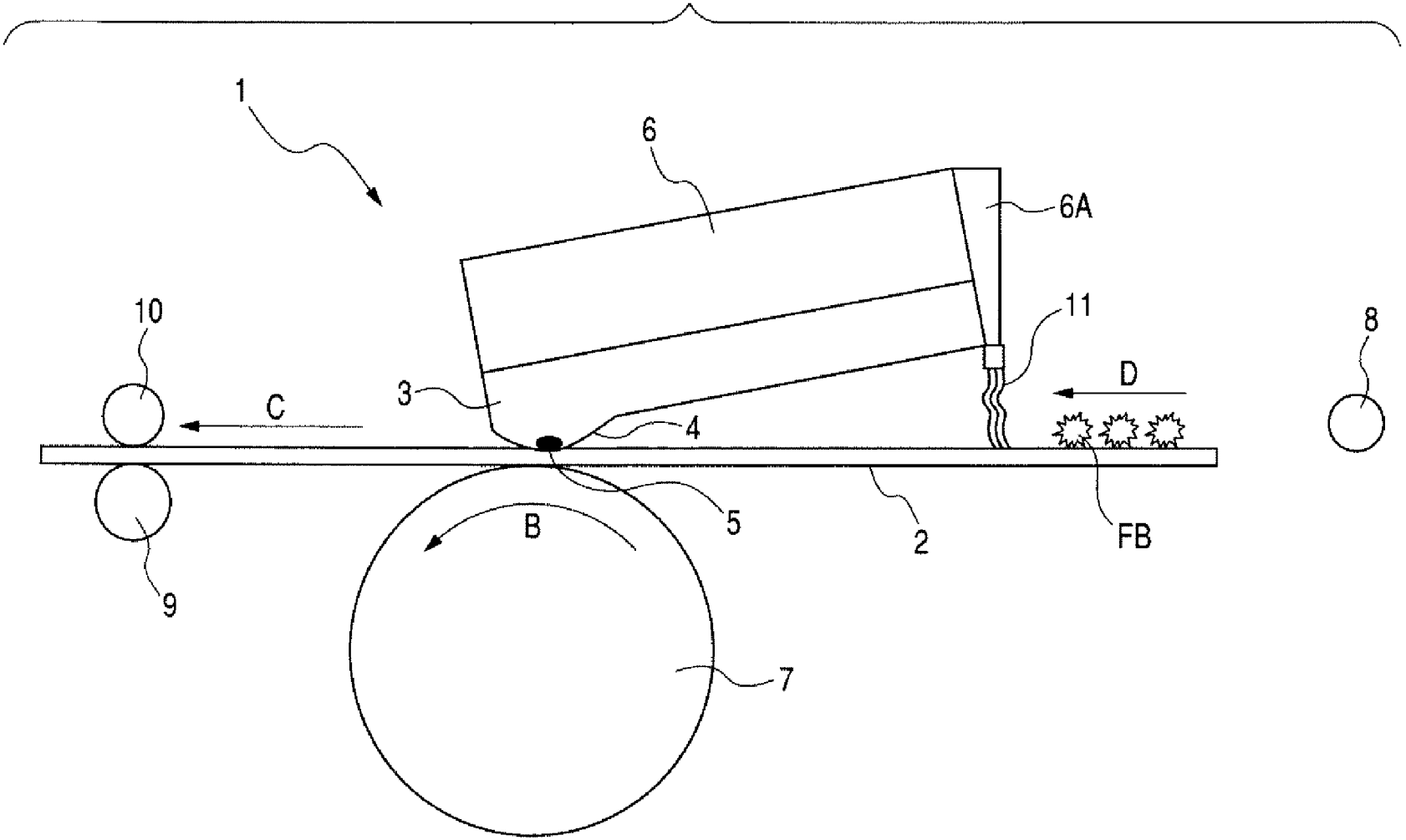
FIG. 1 is a side view of main parts of a line thermal printer according to an embodiment.
Figure 2:
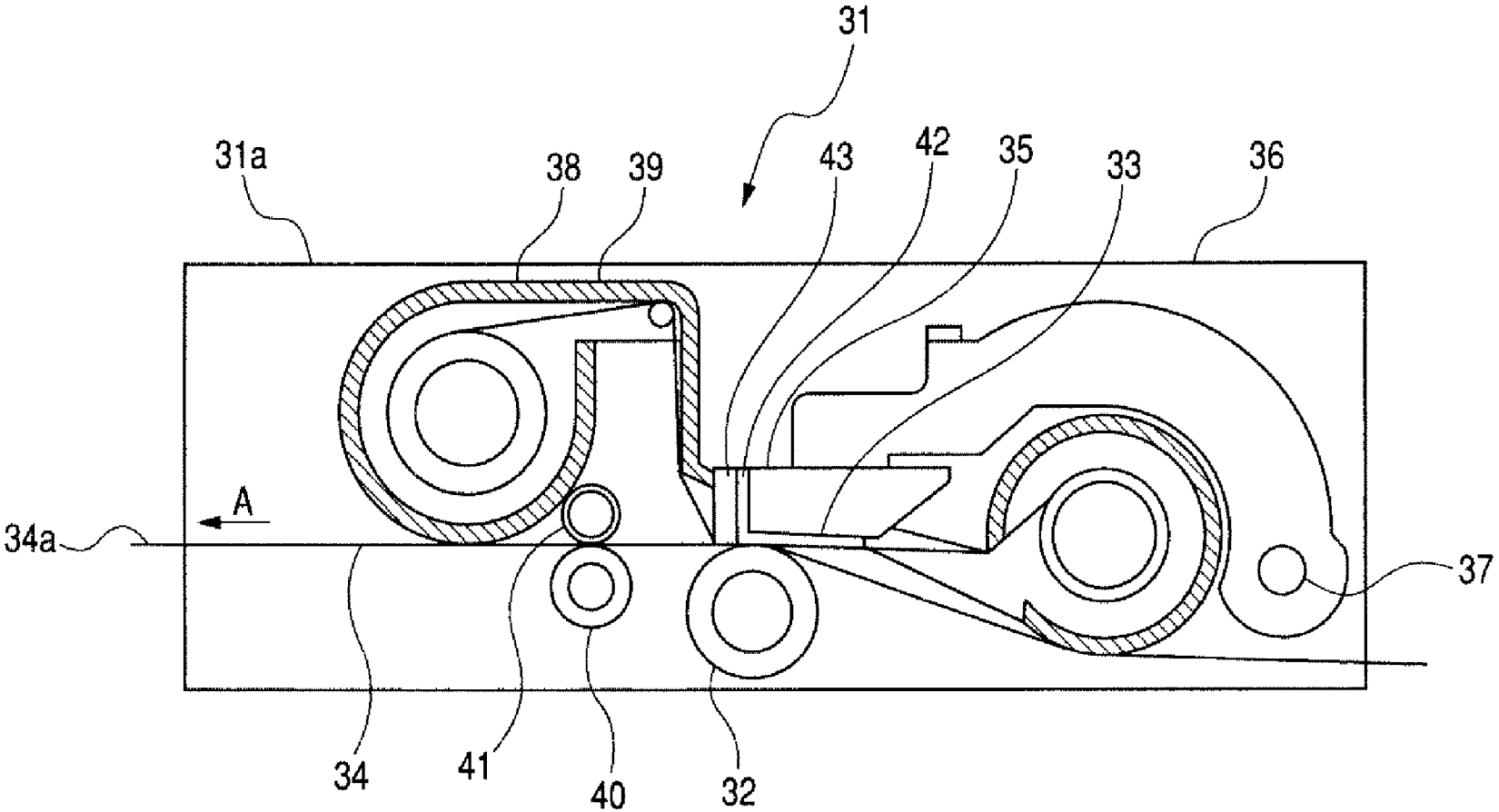
FIG. 2 PRIOR ART
FIG. 2 is a side view of an example of a line thermal printer in the related art.

FIG. 1 is a view showing main parts of a line thermal printer according to various embodiments. A line thermal printer 1 may include a line thermal head 3 that may perform printing by the selective generation of heat of a plurality of heating elements. The plurality of heating elements can selectively generate heat, and may be disposed so as to face the entire area of the recording sheet 2, which may be moved toward the left side in FIG. 1, in a width direction of the recording sheet. A protrusion 4, which may protrude downward, may be formed at the line thermal head 3. The plurality of heating elements 5, 5, . . . , which may be aligned in the width direction of the recording sheet 2, may be provided at the protrusion 4. Meanwhile, a thermal recording sheet may be used as the recording sheet in this embodiment.

The line thermal head 3 may be supported by a thermal head mounting part 6. The line thermal head 3 and the thermal head mounting part 6 may be rotated in both directions about a pivot (not shown) by a cam (not shown).

A platen roller 7, which may be driven by a motor (not shown) so as to be rotated counterclockwise as indicated by arrow B, may be provided below the line thermal head 3. When being at a descent position, the line thermal head 3 may press the recording sheet 2 so that the recording sheet 2 is interposed between the line thermal head 3 and the platen roller 7.

As a paper feeding roller 8 is driven, the recording sheet 2 may be fed from a paper feeding cassette (not shown) that may be positioned on the right side in FIG. 1. Further, a conveyor roller 9 that may be rotationally driven by a motor (not shown) and a pressing roller 10 that is pressed against the conveyor roller 9 may be provided downstream of the line thermal head 3 in a moving direction of the recording sheet 2. Accordingly, the recording sheet 2 may be interposed between the rollers 9 and 10, and may be moved in the direction indicated by arrow C.

A brush 11, which may be made of a resin and may function as a foreign material blocking member, may be provided at a base 6A of the thermal head mounting part 6 in a vertical direction. The foreign material blocking member may be a member used to prevent foreign materials FB, which are placed on the recording sheet 2 and moved, such as dust, grains of sand, and coatings of a thermal recording sheet, from being bitten by the line thermal head 3. A lower end of the brush 11 may come in contact with the recording sheet 2. Further, the brush 11 may extend in a direction perpendicular to the moving direction of the recording sheet 2, and both ends of the brush 11 in a horizontal direction may be positioned at least as the same positions as both ends of the line thermal head 3. The reason for this is to reliably block out the foreign materials FB by the brush 11 so that the foreign materials FE are not bitten by any portion of the line thermal head 3.

Not only the brush 11 but also a flexible plate, which may be made of urethane foam, silicon, rubber, a resin, or the like, may be used as the foreign material blocking member. Further, the brush may be made of a conductive material and grounded. Accordingly, the brush may remove the electric charge of the recording sheet 2 while blocking out the foreign materials FB.

Meanwhile, as long as the foreign material blocking member comes in contact with the recording sheet 2 that is moved toward the downstream side of the paper feeding roller 8, the foreign material blocking member may not be supported by the thermal head mounting part 6. Further, there may be a distance between the foreign material blocking member and the heating elements 5 of the line thermal head 3 of approximately 20 mm or less.

As the paper feeding roller 8 is driven, the recording sheet 2 may be fed from a paper feeding cassette (not shown), pass below the line thermal head 3 that may be spaced apart from the platen roller 7, and fed to a gap between the pressing roller 10 and the conveyor roller 9 that may be rotationally driven. Then, as the rollers 9 and 10 are driven, the recording sheet 2 may continue to be moved until the initial printing position on the recording sheet 2 faces the heating elements 5 of the line thermal head 3. When the initial printing position of the recording sheet 2 faces the heating elements 5 of the line thermal head 3, the movement of the recording sheet 2 may be stopped once.

In this state, the line thermal head 3 may descend so that the recording sheet 2 is interposed between the platen roller 7 and the line thermal head, and the recording sheet 2 is moved again. Then, a specific heating element 5 may selectively generate heat on the basis of print information to partially color the recording sheet 2, so that printing is performed.

Meanwhile, the brush 11 may be provided upstream of the line thermal head 3 in the moving direction of the recording sheet 2 so that the end of the brush may contact the recording sheet 2. Accordingly, even though the foreign materials FB are placed on the recording sheet 2 and are moved together with the recording sheet 2 in a direction indicated by arrow D so as to approach the line thermal head 3, the brush 11 may reliably block out the foreign materials FB so that the foreign materials FB does not reach any portion of the line thermal head 3 in the longitudinal direction of the thermal head and are not bitten by the line thermal head.

As described above, according to the line thermal printer 1, even though being placed on the recording sheet 2, the foreign materials FB may be blocked out by the brush 11 and may not be bitten by the line thermal head 3. Therefore, the damage of the line thermal head 3 caused by the foreign materials FB is prevented, so that it may be possible to always perform high-quality printing.

Since the brush may be made of a conductive material and may be grounded, it may be possible to remove the electric charge of the recording sheet 2 and to block out the foreign materials FB.

Meanwhile, the invention is not limited to the above-mentioned embodiment, and may be modified in various ways if necessary. The brush 11 is made of a conductive material and is grounded as described above, so that it may be possible to remove the electric charge of the recording sheet 2 and to block out the foreign materials FB placed on the recording sheet 2 so that the foreign materials are not bitten by the line thermal head 3.

It should be understood by those skilled in the art that various modifications, combinations, sub-combinations and alterations may occur depending on design requirements and other factors insofar as they are within the scope of the appended claims of the equivalents thereof.

Accordingly, the embodiments of the present inventions are not to be limited in scope by the specific embodiments described herein. Further, although some of the embodiments of the present invention have been described herein in the context of a particular implementation in a particular environment for a particular purpose, those of ordinary skill in the art should recognize that its usefulness is not limited thereto and that the embodiments of the present inventions can be beneficially implemented in any number of environments for any number of purposes. Accordingly, the claims set forth below should be construed in view of the full breadth and spirit of the embodiments of the present inventions as disclosed herein. While the foregoing description includes many details and specificities, it is to be understood that these have been included for purposes of explanation only, and are not to be interpreted as limitations of the invention. Many modifications to the embodiments described above can be made without departing from the spirit and scope of the invention.

What is claimed is:

1. A line thermal printer including a line thermal head and a platen roller, the line thermal head including a plurality of heating elements that are disposed so as to face the entire area of a recording sheet in a width direction of the recording sheet and selectively generates heat, the platen roller being disposed so that the recording sheet is interposed between the platen roller and the line thermal head, and printing being performed at the interposed position on the recording sheet by the selective generation of heat of the heating elements of the line thermal head while the recording sheet is moved, the line thermal printer comprising:

a foreign material blocking member that is disposed upstream of the interposed position so as to come in contact with an upper surface of the recording sheet, and prevents foreign materials, which are placed on the upper surface of the recording sheet, from being moved toward the interposed position, wherein the foreign material blocking member is provided at a base of a thermal head mounting part and wherein the foreign material blocking member is grounded and has an electricity removing function.

2. The line thermal printer according to claim 1, wherein the foreign material blocking member is a brush.

3. The line thermal printer according to claim 2, wherein the foreign material blocking member is provided so as to face the recording sheet that is fed and moved from a sheet cassette.

4. The line thermal printer according to claim 1, wherein the foreign material blocking member is a plate.

5. The line thermal printer according to claim 4, wherein the foreign material blocking member is provided so as to face the recording sheet that is fed and moved from a sheet cassette.

6. The line thermal printer according to claim 1, wherein the foreign material blocking member is provided so as to face the recording sheet that is fed and moved from a sheet cassette.

7. The line thermal printer according to claim 1, wherein the foreign material blocking member is provided so as to face the recording sheet that is fed and moved from a sheet cassette.

* * * * *